US006572120B2

(12) United States Patent
Chang

(10) Patent No.: US 6,572,120 B2
(45) Date of Patent: Jun. 3, 2003

(54) WHEEL ASSEMBLY FOR ROLLER SKATE

(76) Inventor: Chun-Cheng Chang, No. 492-16, Chia-Li Hsin, Chia-Li Chen, Tainan Hsien (TW)

( * ) Notice: Subject to any disclaimer, the term of this patent is extended or adjusted under 35 U.S.C. 154(b) by 0 days.

(21) Appl. No.: 09/932,963

(22) Filed: Aug. 21, 2001

(65) Prior Publication Data

US 2003/0038432 A1 Feb. 27, 2003

(51) Int. Cl.[7] ..... A63C 17/02

(52) U.S. Cl. ..... 280/11.233; 280/11.223

(58) Field of Search ..... 280/11.19, 11.221, 280/11.223, 11.227, 11.233, 11.25, 11.27, 43.24, 11.28, 7.13; 36/114, 115, 132; 16/76

(56) References Cited

U.S. PATENT DOCUMENTS

| | | | | |
|---|---|---|---|---|
| 2,095,942 A | | 10/1937 | Wetterstrand | |
| 3,152,812 A | | 10/1964 | Cummings | |
| 3,884,485 A | | 5/1975 | Walle | |
| 3,979,842 A | | 9/1976 | Texidor | |
| 3,983,643 A | * | 10/1976 | Schreyer et al. | 36/115 |
| 4,333,249 A | * | 6/1982 | Schaefer | 36/115 |
| 4,372,566 A | | 2/1983 | Smith | |
| 4,442,614 A | | 4/1984 | Farberov | |
| 4,928,982 A | | 5/1990 | Logan | |
| 5,312,120 A | | 5/1994 | Wiegner | |
| 5,398,970 A | | 3/1995 | Tucky | |
| 5,511,824 A | | 4/1996 | Kim | |
| 5,785,327 A | | 7/1998 | Gallant | |
| 5,797,609 A | | 8/1998 | Fichepain | |
| 5,803,469 A | | 9/1998 | Yoham | |
| 5,882,018 A | | 3/1999 | Petrosino | |
| 5,887,898 A | | 3/1999 | Petrosino | |
| 6,042,125 A | | 3/2000 | Wu | |
| 6,065,759 A | | 5/2000 | Wu | |
| 6,120,039 A | * | 9/2000 | Clementi | 280/11.19 |
| 6,247,708 B1 | | 6/2001 | Hsu | |
| 6,308,964 B1 | * | 10/2001 | Chang | 280/11.19 |
| 6,328,318 B1 | * | 12/2001 | Hsu | 280/11.223 |
| 6,336,644 B1 | | 1/2002 | Chu | |
| 6,364,322 B1 | * | 4/2002 | Lee | 280/11.27 |
| 6,386,555 B1 | * | 5/2002 | Kao | 280/7.13 |
| 6,386,556 B1 | * | 5/2002 | Yeh | 280/11.223 |
| 6,406,037 B2 | | 6/2002 | Chang | |
| 6,464,236 B2 | * | 10/2002 | Chang | 280/11.233 |
| 6,474,661 B1 | * | 11/2002 | Chang | 280/11.19 |

FOREIGN PATENT DOCUMENTS

| | | |
|---|---|---|
| DE | 2723154 | 12/1978 |
| DE | 19755340 A1 | 6/1999 |
| DE | 19801996 A1 | 7/1999 |
| FR | 2431399 | 3/1980 |
| WO | WO 00/16862 | 3/2000 |

* cited by examiner

*Primary Examiner*—Brian L. Johnson
*Assistant Examiner*—Bryan Fischmann
(74) *Attorney, Agent, or Firm*—Bacon & Thomas

(57) ABSTRACT

A wheel assembly mainly comprises a pivotal seat, a locking device, a singular elastic member and a wheel. The pivotal seat includes a first end pivotally connected to a base by a mounting member for moving between an extended position and an stowed position and a second end rotatably connected to the wheel for skating. The locking device is combined with the singular elastic member as a unit, which is adapted to optionally lock the pivotal seat either in the extended position or in the extracted position by the bias force of the singular elastic member. The singular elastic member is further adapted to bias the pivotal seat for facilitating its movement between the extended position and the stowed position.

9 Claims, 9 Drawing Sheets

WHEEL ASSEMBLY FOR ROLLER SKATE

BACKGROUND OF THE INVENTION

1. Field of the Invention

The present invention is related to a wheel assembly for a roller skate and more particularly to a singular elastic member using to bias a locking means in order to reduce elements and to simplify the entire structure of the wheel assembly.

2. Description of the Related Art

The technology trend in skates manufacturing has been toward convertible shoes. Convertible shoes capable of converting from walking shoes into skates are known in the art. Convertible wheel seats are integral with and fixed to the known convertible shoe. Therefore, a need exists for improved the construction of integrated convertible shoes.

U.S. patent application Ser. No. 09/666,454 filed on Sep. 21, 2000 discloses"Base Structure for Roller Skates". The base structure comprise a base having at least two compartments, a bottom plate secured to the base, and a plurality of wheel assemblies each of which is mounted in the associated compartment. The bottom plate includes a plurality of blocks formed on the under side thereof, each block being received in the associated compartment. Each wheel assembly includes a pivotal seat having a first end secured to the underside of the bottom plate, a wheel seat having a first end pivotally connected to a second end of the pivotal seat, and a wheel rotatably mounted to a second end of the wheel seat. Each wheel seat may be pivoted to a storage position in the associated compartment when not in use. When skating is required, each wheel seat is pivoted to an operative position, in which each wheel seat bears against an underside of an associated block while the wheel rotatably attached to each wheel seat extends beyond the base for skating. Furthermore, the base structure also comprises a first elastic member having a first end attached to the pivotal seat and a second end attached to a mounting member on the wheel seat for biasing the wheel seat to the storage position in the base. A stopping means includes a first end mounted to the pin and a second end through which the mounting member is extended. A second elastic member is mounted around the pin for being adapted to bias a stop of the stopping means to a position for releasably engaging with the wheel seat to prevent the wheel seat from moving into the storage position in the base while the wheel seat and the wheel are extended beyond the base for skating. However, the first elastic member and the second elastic member of the wheel assembly must be assembled as a unit with additional equipment, such as a mounting member and a pin that complicated the entire structure of the wheel assembly. Meanwhile, the combination of the first elastic member and the second elastic member incorporating into the wheel assembly require several operational/assembling steps for manufacture.

The present invention intends to provide a wheel assembly with a singular elastic member actuating a locking means of roller skate in such a way to mitigate and overcome the above problem.

SUMMARY OF THE INVENTION

The primary objective of this invention is to provide a wheel assembly for a roller skate including a singular elastic member actuating a locking means in order to reduce elements and to simplify entire structure of the wheel assembly.

The secondary objective of this invention is to provide the wheel assembly for a roller skate including a singular elastic member which performs multi-function incorporating into a pivotal seat to thereby reduce operational/assembling steps in manufacture process.

The present invention is the wheel assembly for a roller skate. The wheel assembly mainly comprises a pivotal seat, a locking means, a singular elastic member and a wheel. The pivotal seat includes a first end pivotally connected to a base by a mounting member for moving between an extended position and an stowed position and a second end rotatably connected to the wheel for skating. The locking means is combined with the singular elastic member as a unit, which is adapted to optionally lock the pivotal seat either in the extended position or in the extracted position by the bias force of the singular elastic member. The singular elastic member is further adapted to bias the pivotal seat for facilitating and guiding to move between the extended position and the stowed position.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
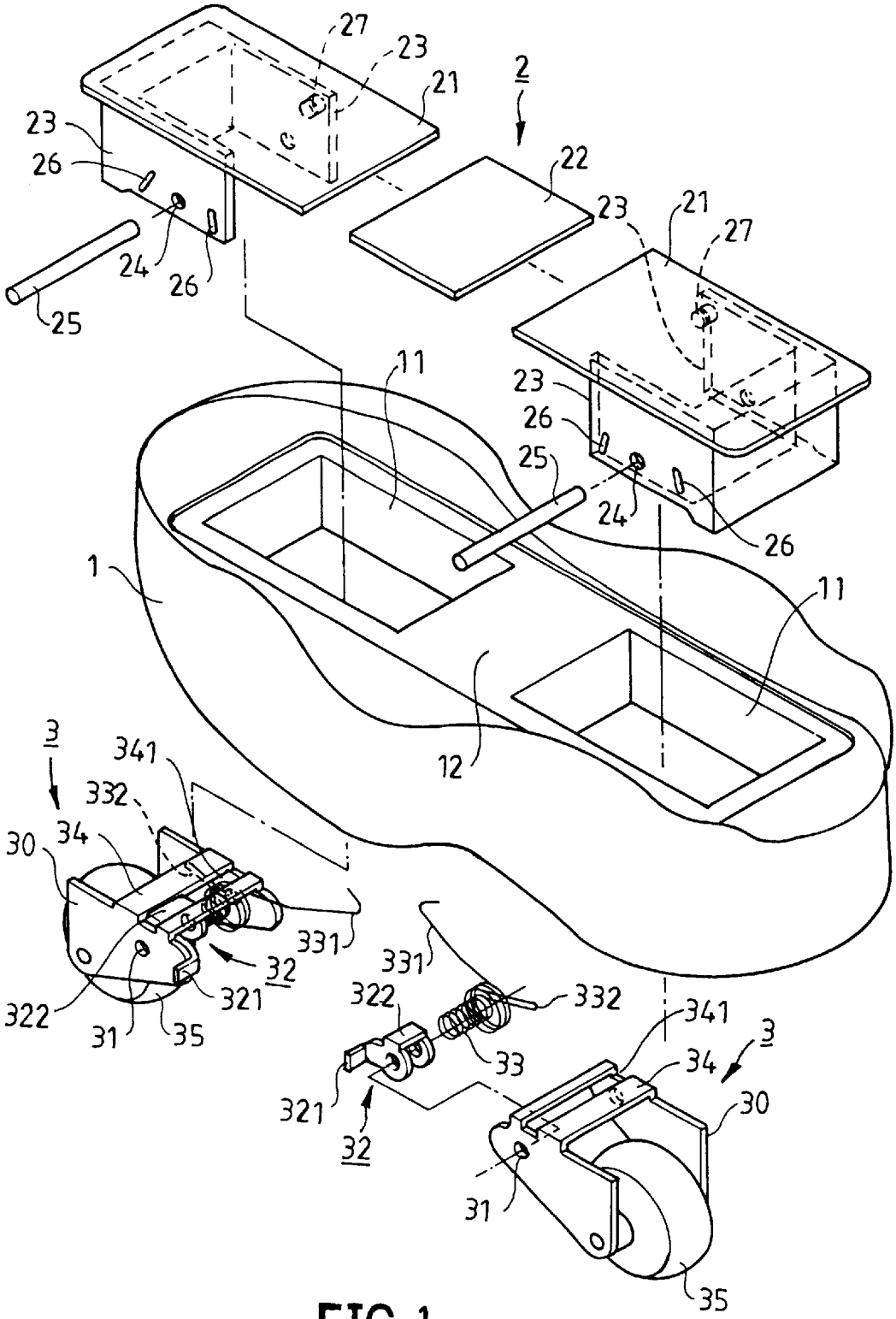
FIG. 1 is an exploded perspective view of the roller skate in accordance with the first embodiment of the present invention.

Referring now to the drawings, there are three embodiments of the present invention shown therein, all of which include generally a primary sole member and a secondary shoe member (in dotted line).

Figure 6:
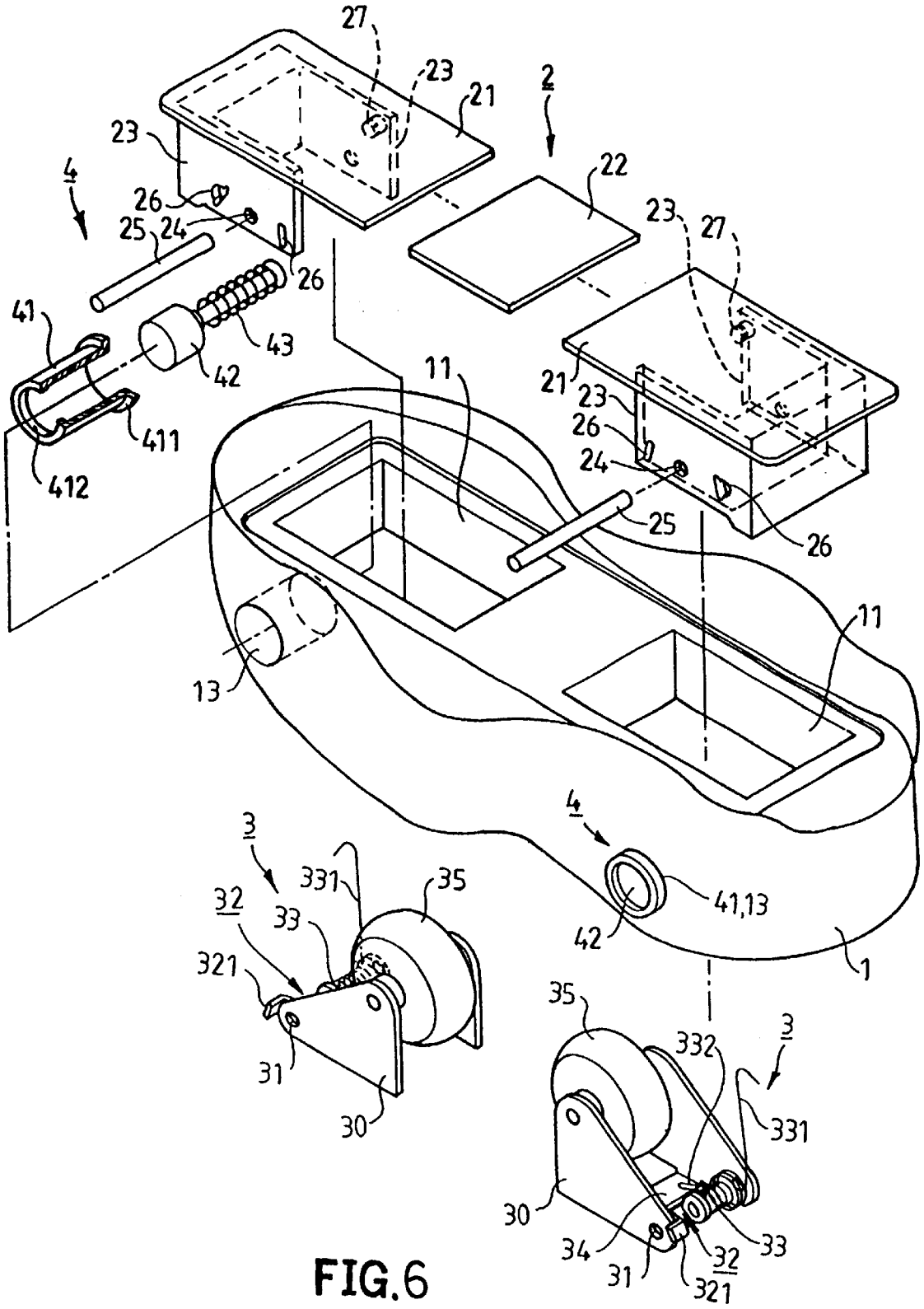
FIG. 6 is an exploded perspective view of the roller skate in accordance with the second embodiment of the present invention.
Figure 9:
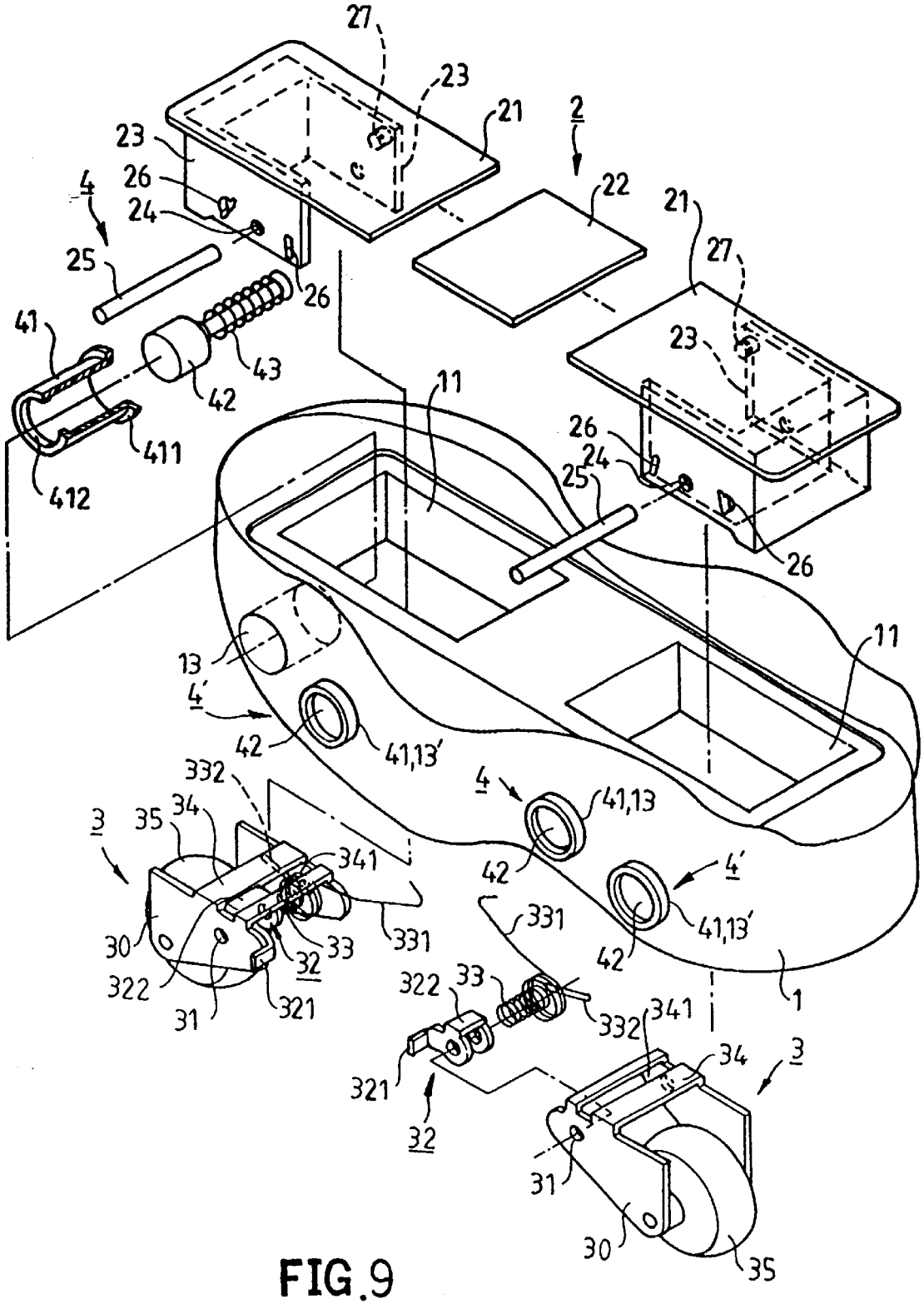
FIG. 9 is an exploded perspective view of the roller skate in accordance with the third embodiment of the present invention.

Referring initially to FIGS. 1, 6 and 9, a roller skate in accordance with the present invention generally includes a sole designated as numeral 1, a sole-pad device designated as numeral 2, a pair of bases designated as numeral 21 and a pair of wheel assemblies designated as numeral 3. The sole 1 comprises two cavities 11 having an opening defined therein and an upper side 12 mounted a sole-pad 22 between two cavities 11. The bases 21 are mounted in the associated cavity 11, which can functionally stow, extract and lock the wheel assembly 3. The base 21 comprises an upper wall and an annular sidewall 23 on which are provided two holes 24 pivotally receiving a mounting member 25, a pair of slots 26 and a pair of pivots 27 projected on the inner circumference proximate the upper wall.

Figure 2:
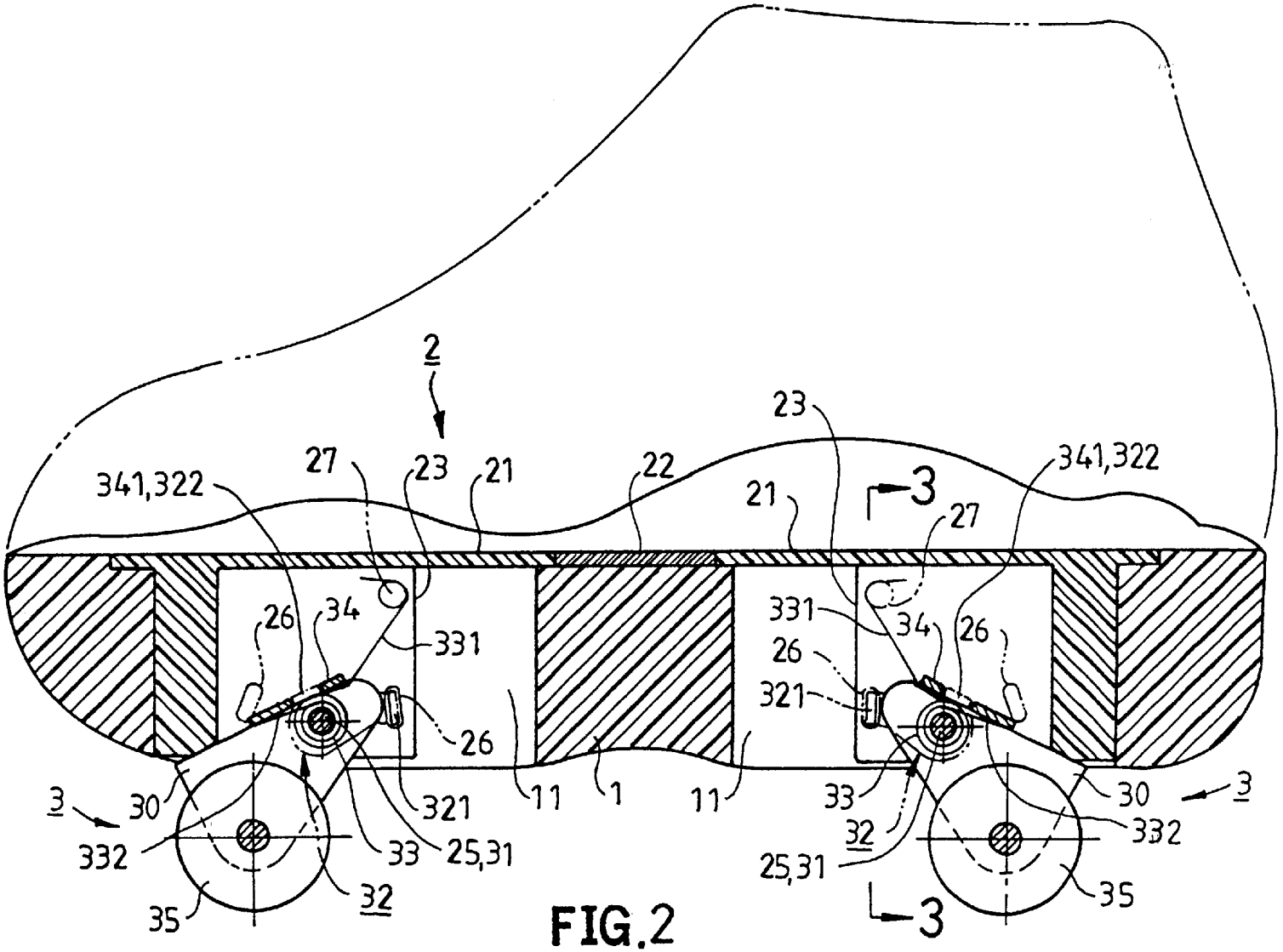
FIG. 2 is a partial cross-sectional view of the roller skate locked in an extended position in accordance with the first embodiment of the present invention.

Construction of the wheel assembly 3 shall be described in detail, referring now to FIGS. 1 and 2. The wheel assembly for roller skate in accordance with a first embodiment of the present invention mainly includes a pivotal seat 30, a locking means 32, a singular elastic member 33 and a wheel 35. The pivotal seat 30 is formed from a frame having two arms which are parallel to a common plane and connected by an upper wall 34 which further has a slot 341. The pivotal seat 30 comprises a first end having a pair holes 31 pivotally connected to the base 21 by the mounting member 25 for moving between an extended position and a stowed position and a second end rotatably connected to the wheel 35 for skating. The locking means 32 is formed from a frame having a stop 321 and a head 322. The singular elastic member 33 such as a coil spring defined a longitudinal axis and comprises two ends 331, 332, and two side contact portions. The locking means 32 and the singular elastic member 33 are coaxially assembled on the mounting member 25 and confined within two arms of the wheel/pivotal seat 30. One side contact portion of the singular elastic member 33 is attached to the locking means 32 while the other side contact portion is attached to the pivotal seat 30 in a way that the stop 321 is optionally forced to engage with one of the slots 26 of the base 21. When assembled, the head 322 of the locking means 32 is received in the slot 341 of the pivotal seat 30 so that they move synchronously with relation to the base 21. As previously mentioned, the locking means 32 is combined with the singular elastic member 33 as a unit, which is adapted to optionally lock the pivotal seat 30 either in the extended position or in the stowed position by the bias force of the singular elastic member 33. The combination of the pivotal seat 30 and the locking means 32 can be optionally positioned in the extended position or in the stowed position. In addition, the singular elastic member 33 is further adapted to bias the pivotal seat 30 for facilitating and guiding to move between the extended position and the stowed position. Accordingly, one end 331 of the singular elastic member 33 hooks one of the pivot 27 of the base 21 while the other end 332 is attached to the underside of the upper wall 34 of the pivotal seat 30. The singular elastic member 33 may be optionally constructed to bias to guide the pivotal seat 30 either in a direction moving to the extended position or in an inverted direction moving to the stowed position.

Figure 3:
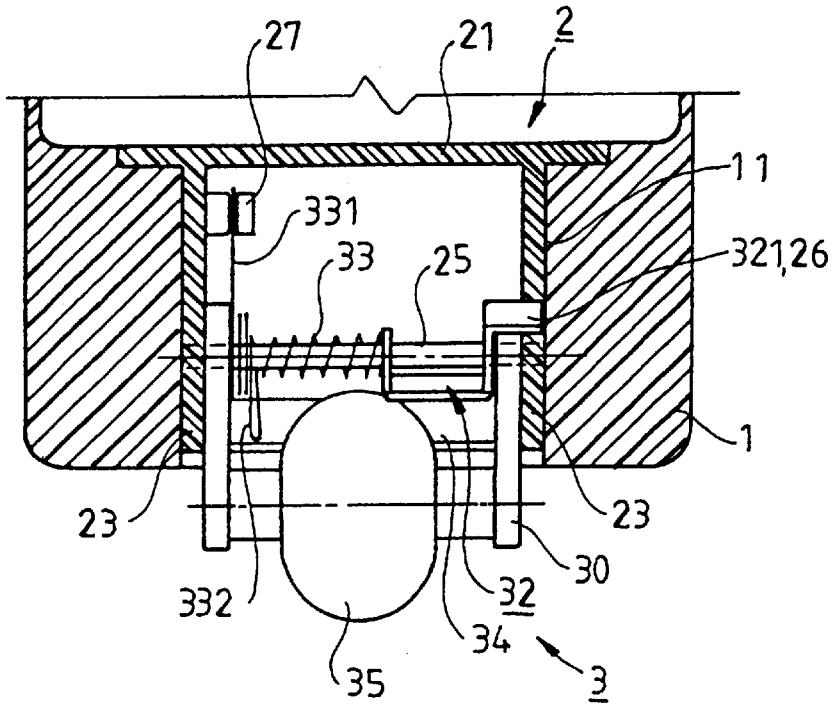
FIG. 3 is a cross-sectional view, taken along 3—3 in FIG. 2, of the roller skate in accordance with the first embodiment of the present invention.

Extended operation of the wheel assembly 3 shall now be described with reference to FIGS. 2 and 3. In the extended position, the singular elastic member 33 biases the pivotal seat 30 to prevent it from returning to the stowed position and to guide it moving to the extended position until locked. As the pivotal seat 30 is moved forward to a predetermined position, the stop 321 of the locking means 32 is releasably engaged with the slot 26 of the base 21 such that the entire wheel assembly 3 is locked in the extended position.

Figure 4:
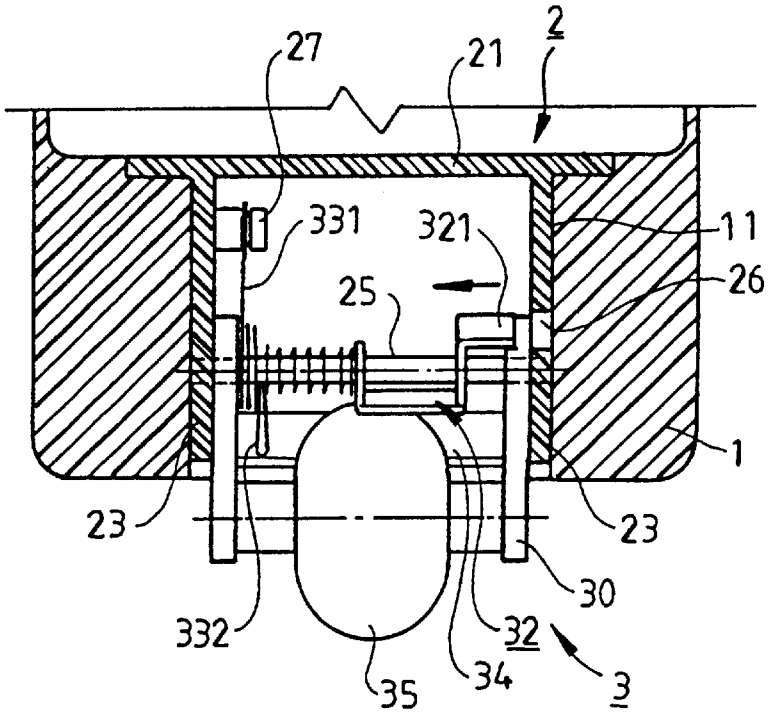
FIG. 4 is a partial cross-sectional view of the locking means of the roller skate being pressed to unlock in the extended position in accordance with the first embodiment of the present invention.

Unlocked operation of the wheel assembly 3 shall now be described with reference to FIGS. 2 and 4. It is still situated in the extended position. As can be seen in FIG. 4, the singular elastic member 33 and the locking means 32 are pressed together to move along the mounting member 25 so that the stop 321 of the locking means 32 is released from the slot 26 of the base 21. The pivotal seat 30 can be optionally moved backward to the stowed position into the cavity 11 of the sole 1 from the extended position.

Figure 5:
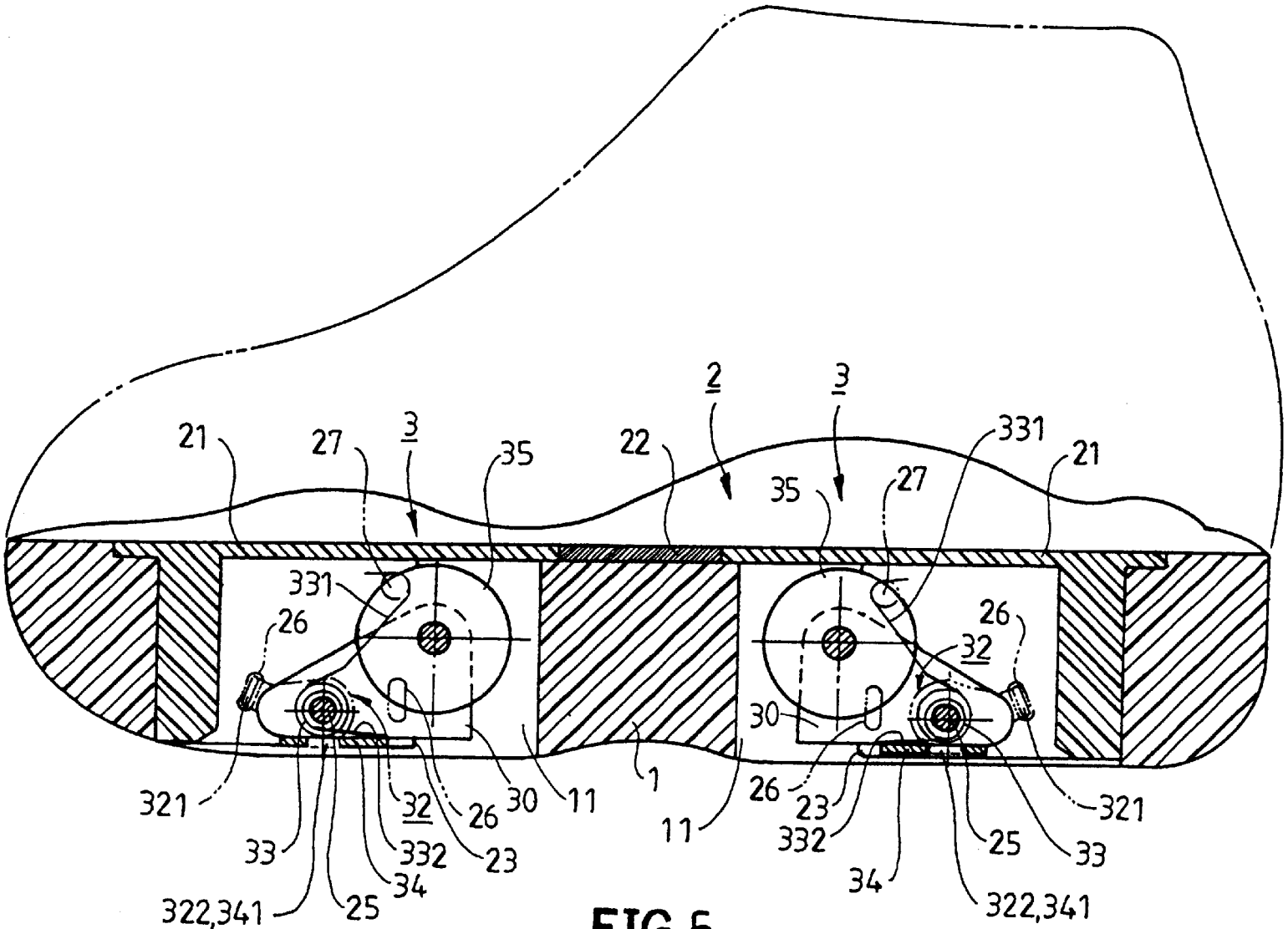
FIG. 5 is a partial cross-sectional view of the roller skate locked in a stowed position in accordance with the first embodiment of the present invention.

Stowed operation of the wheel assembly 3 shall now be described with reference to FIG. 5. When the pivotal seat 30 is moved backward to the stowed position, the stop 321 of the locking means 32 is moved corresponding from one of the slot 26 to the other. As the pivotal seat 30 is moved backward to a predetermined position, the stop 321 of the locking means 32 is releasably engaged with the other slot 26 of the base 21 such that the entire wheel assembly 3 is locked in the stowed position into the cavity 11 of the sole 1.

Figure 7:
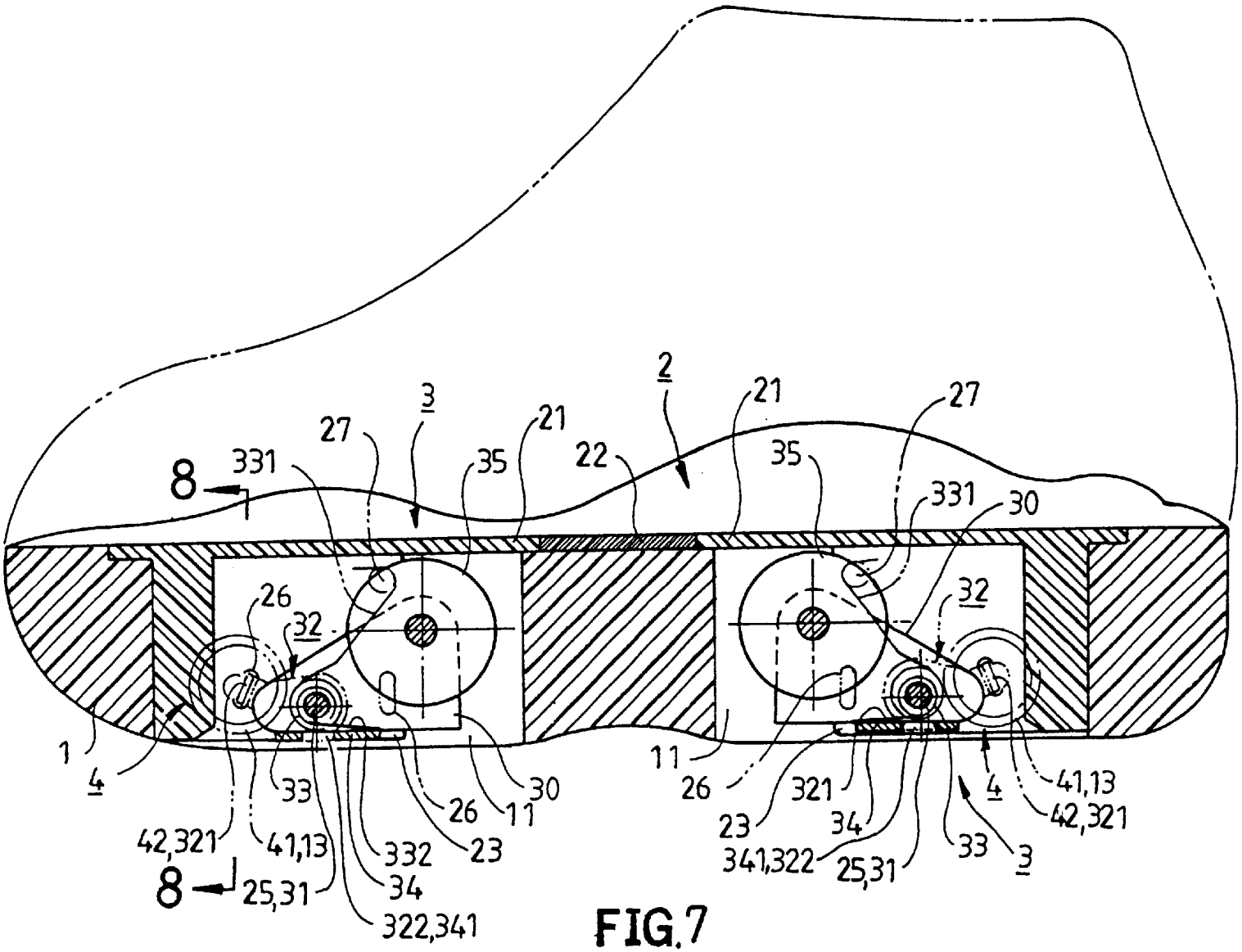
FIG. 7 is a partial cross-sectional view of the roller skate locked in a stowed position in accordance with the second embodiment of the present invention.
Figure 8:
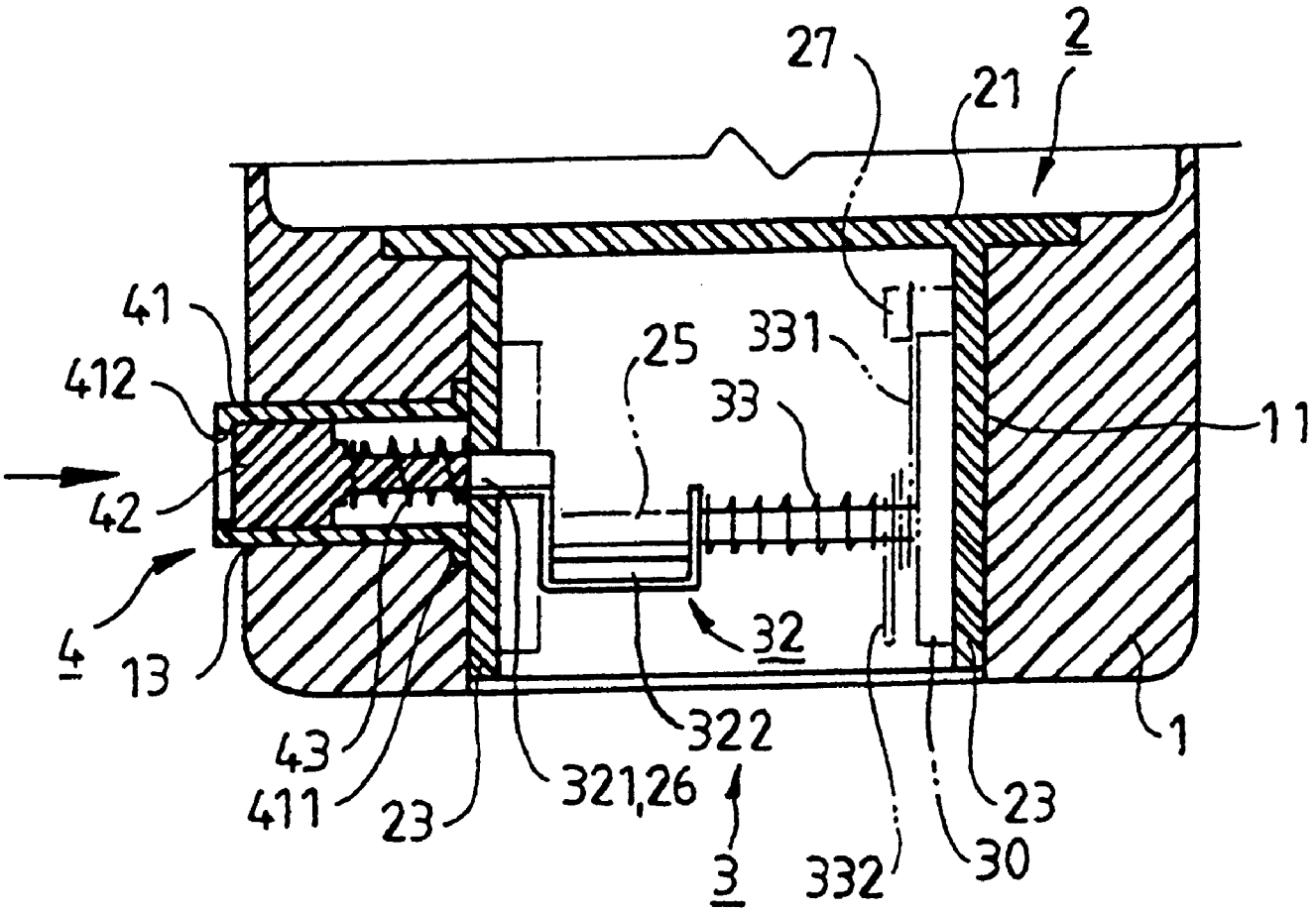
FIG. 8 is a cross-sectional view, taken along 8—8 in FIG. 7, of the roller skate in accordance with the second embodiment of the present invention.

Referring to FIGS. 6–8, reference numerals of the second embodiment have applied the identical numerals of the first embodiment. The sole 1, the sole-pad device 2, the base 21 and the wheel assembly 3 of the second embodiment have the similar configuration and same functions as the first embodiment and the detailed descriptions are omitted. The sole 1 further comprises a pair of holes 13 provided on its outer circumference and connected to the associated cavity 11. The wheel assembly 3 in accordance with the second embodiment of the present invention comprises a control means 4 applied to actuate the locking means 32 so that the wheel assembly 3 can be automatically released from the cavity 11 of the sole 1. The control means 4 is fittingly secured in the hole 13 of the sole 1.

Construction of the control means 4 shall be described in detail, referring now to FIGS. 6–8. The control means 4 in accordance with a second embodiment of the present invention mainly includes a cylindrical tube 41, a button 42 and a spring 43. The cylindrical tube 41 comprises a radially outer annular flange 411 at its first end and a radially inner annular flange 412 at its second end. The button 42 is coaxially combined with the spring 43. The combination of them is slidably inserted into the cylindrical tube 41 and axially confined within the space defined by the radially inner annular flange 412 of the cylindrical tube 41. The radially outer annular flange 411 of the cylindrical tube 41 is initially secured around the inner end of the hole 13. When assembled, the button 42 has a first end exposed on the outer circumference of the sole 1 and a second end aligned with the stop 321 of the locking means 32 in the cavity 11.

Unlocked operation of the wheel assembly 3 shall now be described with reference to FIGS. 7 and 8. The pivotal seat 30 is still situated in the stowed position in the cavity 11. As can be seen in FIG. 7, the singular elastic member 33 biases the pivotal seat 30 to facilitate returning to the extended position from the stowed position. The stop 321 of the locking means is locked in the slot 26 of the base 21. As the button 42 is pressed a predetermined distance, the stop 321 is released from the slot 26 and the wheel assembly 3 is automatically released from the cavity 11 returning to the extended position by the bias force of the singular elastic member 33.

Figure 10:
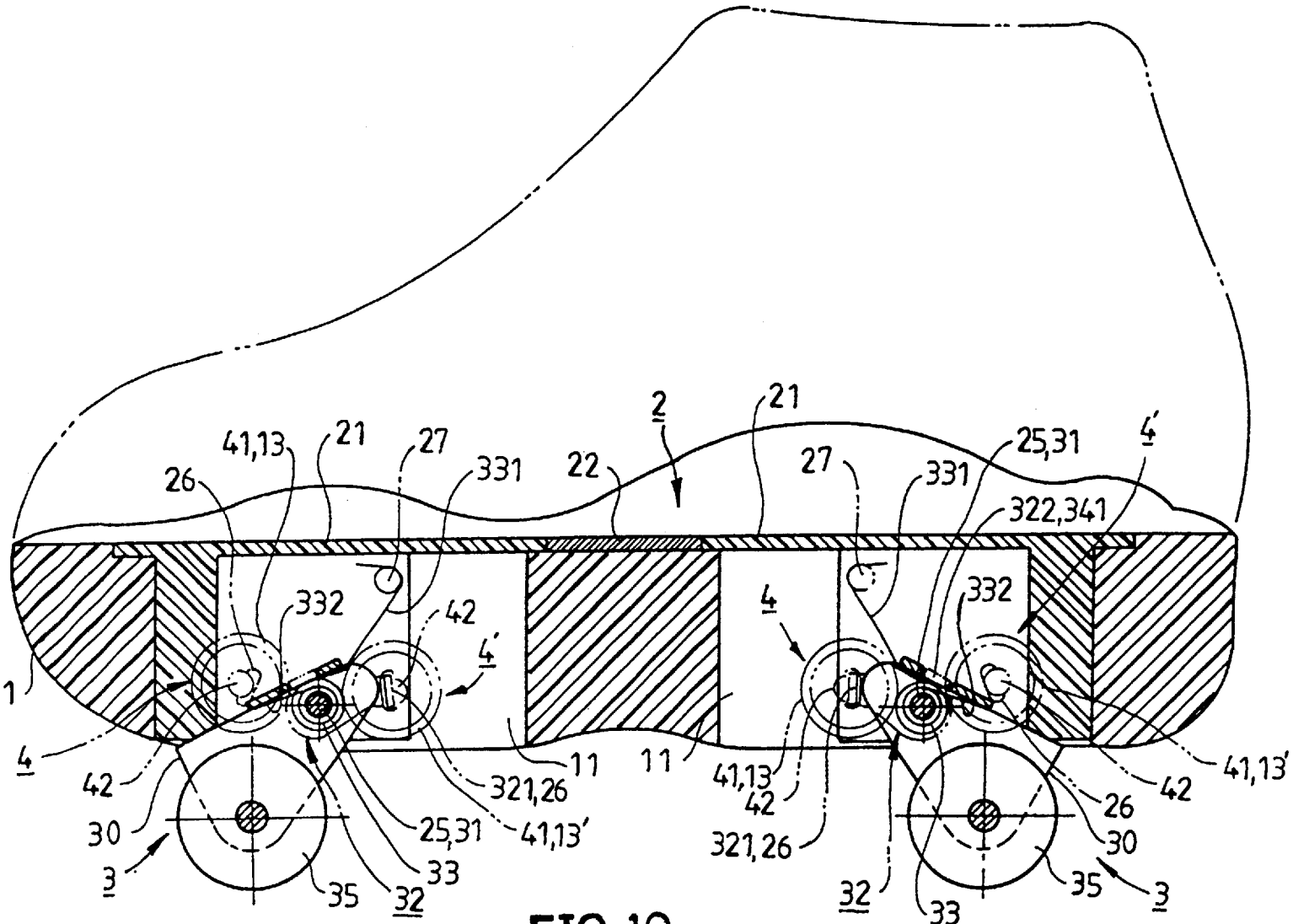
FIG. 10 is a partial cross-sectional view of the roller skate locked in an extended position in accordance with the third embodiment of the present invention.

Referring to FIGS. 9–10, reference numerals of the third embodiment have applied the identical numerals of the previous embodiments. The sole 1, the sole-pad device 2, the base 21, the wheel assembly 3 and the control means 4 of the third embodiment have the similar configuration and same functions as the previous embodiments and the detailed descriptions are omitted. The sole 1 comprises four holes 13 provided on its outer circumference and connected to the associated cavity 11. The wheel assembly 3 in accordance with the third embodiment of the present invention comprises two control means 4 and 4' applied to actuate the locking means 32 at its two predetermined positions. The two control means 4 and 4' are fittingly secured in the associated holes 13 and 13' of the sole 1 respectively.

Referring to FIG. 10, the first and second control means 4 and 4' are aligned with the associated slot 26 of the base 21. As the button 42 of the control means 4 is optionally pressed a predetermined distance, the stop 321 is released from the slot 26. The first control means 4 is applied to release the stop 321 of the locking means 32 locked in the first slot 26 at the extended position so that the wheel assembly 3 can be returned to the stowed position. The second control means 4' is also applied to release the stop 321 of the locking means 32 locked in the second slot 26 at the stowed position so that the wheel assembly 3 can be moved to the extended position.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A wheel assembly for a roller skate which retracts into a cavity of a sole, comprising:

a pivotal seat comprising a first end pivotally connected to a base for moving between an extended position and a stowed position and a second end;

a locking means comprising a stop being adapted to releasably lock the pivotal seat either in the extended position or in the stowed position;

a singular elastic member comprising a first end attached to the pivotal seat and a second end attached to the base, the singular elastic member being adapted to bias the pivotal seat to move between the extended position and the stowed position;

the singular elastic member further comprising a first side contact portion abutting against the pivotal seat and a second side contact portion abutting against the locking means, the singular elastic member being adapted to bias the locking means to lock the pivotal seat either in the extended position or in the stowed position; and a wheel rotatably connected to the second end of the pivotal seat for skating.

2. The wheel assembly for a roller skate as defined in claim 1, wherein the base provides two slots to engage with the stop in the extended position or in the stowed position.

3. The wheel assembly for a roller skate as defined in claim 1, wherein the locking means and the singular elastic member are coaxially assembled on a mounting member and confined within two arms of the pivotal seat.

4. The wheel assembly for a roller skate as defined in claim 1, wherein the locking means is combined with the singular elastic member as a unit, which is adapted to lock the pivotal seat in the extended or stowed position by the bias force of the singular elastic member.

5. The wheel assembly for a roller skate as defined in claim 1, further comprising a control means applied to release the locking means from the extended position or from the stowed position.

6. The wheel assembly for a roller skate as defined in claim 5, wherein the control means comprises a cylindrical tube, a button and a spring.

7. The wheel assembly for a roller skate as defined in claim 6, wherein the button is coaxially combined with the spring and then slidably inserted into the cylindrical tube; when assembled, the button has a first end exposed on the outer circumference of the sole and a second end aligned with the stop of the locking means.

8. The wheel assembly for a roller skate as defined in claim 1, further comprising two control means, one control means applied to release the locking means from the extended position and the other control means applied to release the locking means from the stowed position.

9. The wheel assembly for a roller skate as defined in claim 7, wherein a button of the control means is aligned with the stop of the locking means at the extended position and the stowed position.

* * * * *